United States Patent [19]

Luft et al.

[11] Patent Number: 4,991,552

[45] Date of Patent: Feb. 12, 1991

[54] THROTTLE VALVE SETTING DEVICE

[75] Inventors: Jürgen Luft, Bad Soden; Erwin Schneider, Liederbach, both of Fed. Rep. of Germany

[73] Assignee: VDO Adolf Schindling AG, Frankfurt am Main, Fed. Rep. of Germany

[21] Appl. No.: 485,093

[22] Filed: Feb. 23, 1990

[30] Foreign Application Priority Data

Apr. 3, 1989 [DE] Fed. Rep. of Germany ..... 3910661
Apr. 5, 1989 [DE] Fed. Rep. of Germany ..... 3910948
May 19, 1989 [DE] Fed. Rep. of Germany ..... 3916296

[51] Int. Cl.[5] ..... F02D 7/00
[52] U.S. Cl. ..... 123/401; 123/332
[58] Field of Search ..... 123/401, 376, 378, 395, 123/342, 319, 332, 396; 251/129.01, 129.11

[56] References Cited

U.S. PATENT DOCUMENTS

| | | | |
|---|---|---|---|
| 4,384,559 | 5/1983 | Tchang et al. | 123/332 |
| 4,471,611 | 9/1984 | Watanabe | 123/401 |
| 4,510,906 | 4/1985 | Klatt | 123/396 |
| 4,574,757 | 3/1986 | Schalman et al. | 123/401 |
| 4,660,518 | 4/1987 | Tamaki | 123/401 |

*Primary Examiner*—Raymond A. Nelli
*Attorney, Agent, or Firm*—Martin A. Farber

[57] ABSTRACT

A throttle-valve setting device has, for idle adjustment, a motor setting lever (10) which displaces a throttle valve (3) and is connected via a path-dependent controlling movement-reversal device (15) to a setting member (13) of a setting motor (12). Thereby, upon activation of the setting motor (12), the setting lever (10) first swings slightly in one direction and then in the other direction to the full-load position of the throttle valve (3).

8 Claims, 7 Drawing Sheets

THROTTLE VALVE SETTING DEVICE

FIELD AND BACKGROUND OF THE INVENTION

The present invention relates to a throttle-valve setting device which has a throttle valve setting lever which is connected to an accelerator pedal and actuates a throttle valve arranged, fixed for rotation, on a throttle valve shaft, the invention including a setting motor operating exclusively in the opening direction of the throttle valve against the force of a return spring in order to permit idling adjustment.

Such throttle valve setting devices are provided in modern motor vehicles and are therefore known.

In today's motor vehicles the internal combustion engine must produce different torques also upon idling. The power required, for example, increases when the air conditioner of a motor vehicle is to operate upon idling. When the internal combustion engine is cold, more energy is required in order to keep it operating than when the internal combustion engine is warm. In order to be able to keep the idling speed of rotation as low as possible under such different conditions, idling adjustment is being provided more and more generally. In such case, the throttle valve can be opened by means of the setting motor to a greater or lesser extent within a stipulated operating range without the driver having to actuate the accelerator pedal for this.

The known idling controls have the disadvantage of their behavior upon failure of the energy actuating their setting motor. Ordinarily, the idling adjustment is designed in the manner that the throttle valve is swung, by a setting spring, into a position in which the idling speed of rotation reaches the upper value of the operating range available for the idling control. In practice, such high idling speeds of rotation induce an automatic transmission to enter into gear. If the idling control is developed in such a manner that, upon a failure of the external energy, the throttle valve reaches its substantially closed final position, then the internal combustion engine generally stalls upon idling, which is a nuisance and disadvantage for safety in travel.

SUMMARY OF THE INVENTION

It is an object of the invention to develop a throttle-valve setting device of the aforementioned type in such a manner than, upon failure of the energy of the setting motor upon idling, an average idling speed of rotation automatically results.

According to the invention, for actuation of the throttle valve (3) by the setting motor (12), there is provided a movement-reversal device (15) which switches as a function of the distance. The movement-reversal device is mechanically connected in such a manner with a setting member (13) of the setting motor (12), that upon a displacement of the setting member (13) from its position which is the result of the return spring (5), the throttle valve (3) first of all swings slightly in the closing direction and then, upon further displacement of the setting member (13), in the opposite direction.

By this development the result can be obtained that, upon a failure of the energy of the setting motor, the setting member is pulled by a setting spring into an emergency position in which the throttle valve assumes an average idle open position. By the operation of movementreversal device the result is obtained, upon the action of energy on the setting motor, that upon a displacement of the setting member, the throttle valve initially swings in one direction, then closes further and thereupon moves in the opposite direction until the throttle valve has reached the angle of opening which is maximum for the idling adjustment. Although the setting motor operates only in one direction, thanks to the invention, it is possible with the setting motor alone, by displacing its setting member in only one direction, first of all to close the throttle valve further and then, upon further displacement of the setting member, in the same direction, to open it further again. In this way, an optimal idling control is possible without there being an undesirably high speed of rotation of the engine or a stalling of the engine in the case of failure of the energy of the setting motor.

The displacement of the throttle valve for the purpose of idling speed control must be superimposed on the throttle-valve displacement by the accelerator pedal. This can be done in simple fashion by providing a double-armed driver lever (4) which is connected, fixed for rotation, on the throttle-valve shaft (2) and urged by the return spring (5) in the closing direction of the throttle valve (3), against which driver lever (4) the throttle-valve setting lever (6) rests from one side by means of a driver (7) against a lever arm of the driver lever (4) and against which the motor-setting lever (10) rests from the other side via a driver (11) on the other lever arm.

The movement-reversal device can be developed very simply from mechanical structural parts in that, in accordance with one advantageous feature of the invention, the movement-reversal device (15) has an intermediate lever (16) which is pivoted on the motor setting lever (10) with a toggle-joint lever pivot (17) and on the setting member (13) of the motor (12), said intermediate lever being held in the end position which results when no energy is acting on the setting motor (12) by a setting spring (14), against a stop (20) fastened on the housing between the articulation on the engine-setting lever (10) and the setting member (13) and in the manner that the motor setting lever (10) has, on the side opposite the stop (20), a driver (18) against which the intermediate lever (16) can be moved after slight swinging in the setting direction of the setting motor (12).

Since the setting motor must operate against the return spring and the setting spring for the displacement of the throttle valve for adjusting of the idling, it is desirable that the force of the setting spring be as small as possible. This is achieved by urging the motor setting lever (10) and the intermediate lever (16) into the inward position by a leg spring (19) which is weaker than the setting spring (14) and is arranged on the toggle-lever pivot (17). By this development, the force of the leg spring no longer increases despite an increasing actuating stroke of the setting motor as soon as the intermediate lever rests against the driver of the motor setting lever.

Another very simple embodiment of the movement-reversal device (15) has a bell-crank lever (21) with a first lever arm (22) against which the motor setting lever (10) is held, forming a tilt axis, and with a second lever arm (25) against which the setting member (13) of the setting motor (12) is held by the setting spring (14). Also, at the end of the setting member (13) there is provided a driver (23) which, after a short stroke, in the direction which results from the action of energy on the setting motor (12), arrives against the motor setting lever (10).

Another particularly simple embodiment of the throttle-valve setting device (15) is formed by a cam (27) on the motor setting lever (10) against which the throttle-valve setting lever (6) rests. The cam makes it possible to develop the dependence between the stroke of the setting motor and the throttle-valve angle as desired.

Such a setting device is constructed in very simple manner with a cam if the motor setting lever (10) is formed as a double-armed lever swingable around a shaft (26), and having a first lever arm of which the setting member (13) of the setting motor (12) is pivoted and a second lever arm which includes the cam (27).

A precise adjustment of the throttle valve setting device can be obtained with a very simple structural part if the shaft (26) of the engine-setting lever (10) is developed as an adjustment eccentric which permits displacement of the motor setting lever (10).

BRIEF DESCRIPTION OF THE DRAWINGS

With the above and other objects and advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
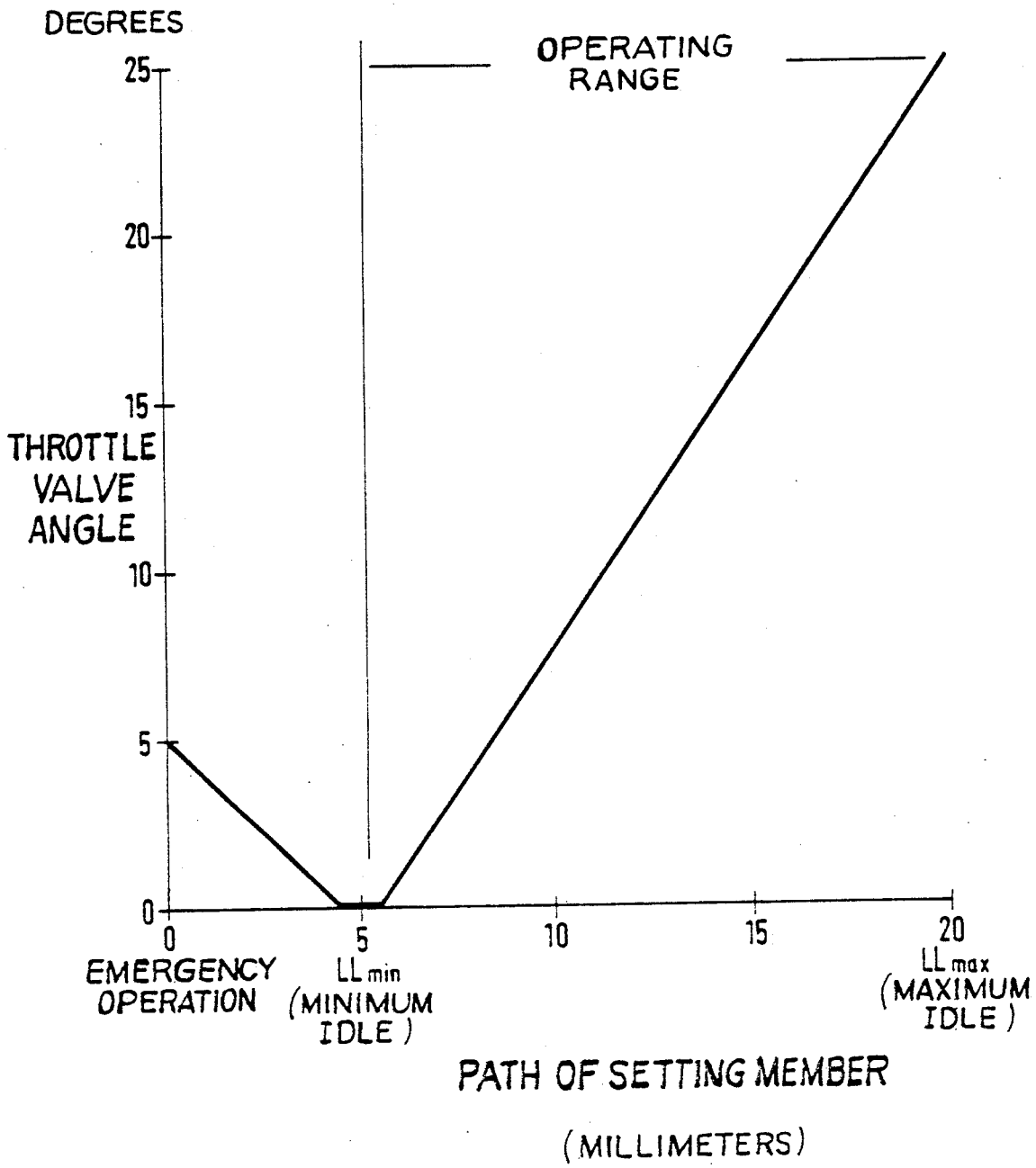
FIG. 1 is a graph showing the desired dependence of the throttle-valve angle on the setting path of the setting motor.

In the graph of FIG. 1, the optimal throttle-valve opening angle is plotted over the setting path of a setting motor. It can be noted that, upon actuation of the setting motor, the throttle-valve opening angle decreases first of all from about 5 degrees to about 0 and then increases to about 25 degrees. The region close to 0 degrees to 25 degrees is the operating region in which the idling control operates. If the energy of the setting motor fails, then a return spring can move the setting member of the setting motor into an emergency position in which the throttle valve is open about 5 degrees. The optimal course of the characteristic curve shown in FIG. 1 can be obtained with the two throttle-valve setting devices which are shown in the following figures.

Figure 2:
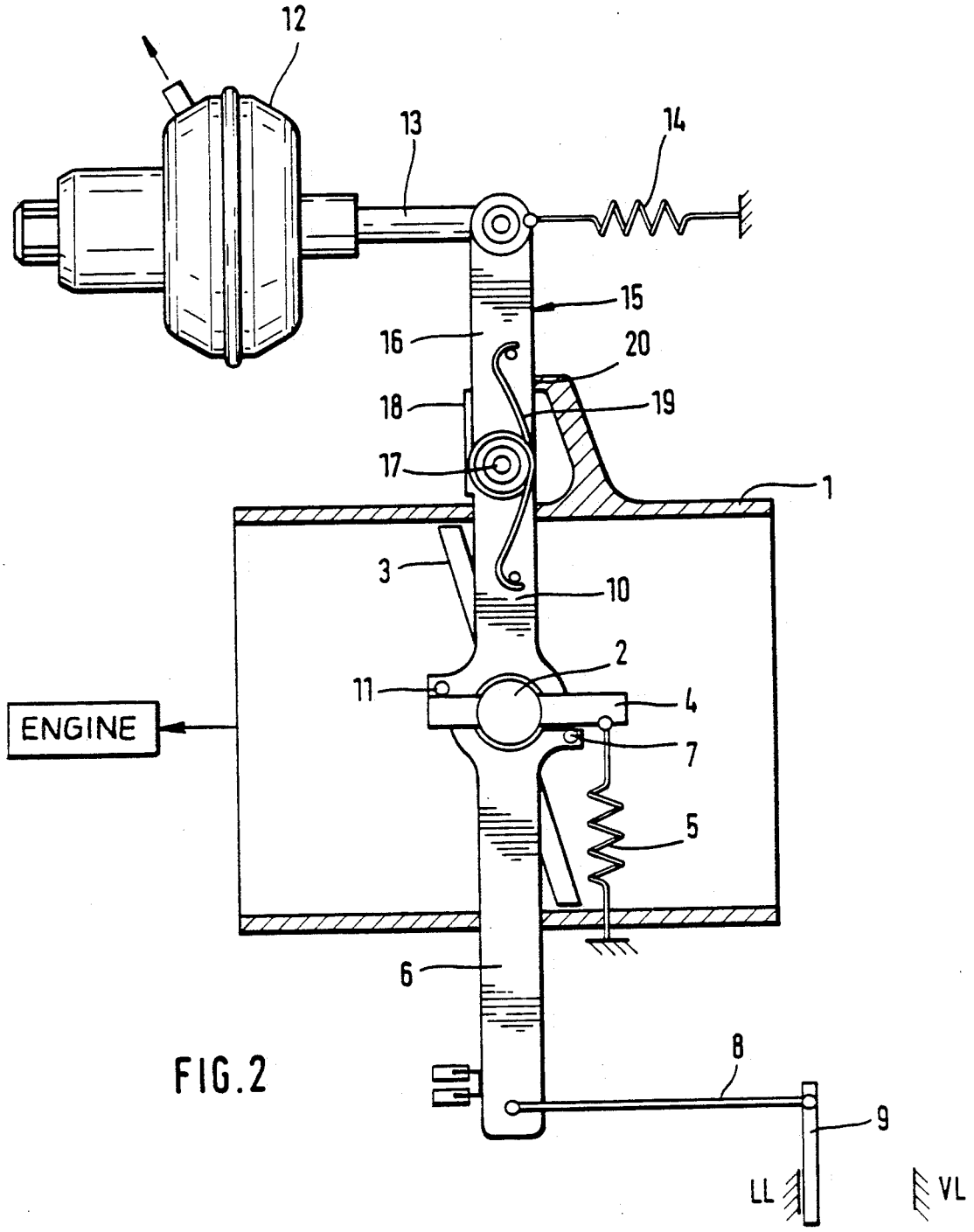
FIG. 2 is a basic diagram of the throttle-valve setting device of the invention in the position which results upon minimum idling opening of the throttle valve.

FIG. 2 shows a throttle-valve housing 1 within which a throttle valve 3 is arranged in non-rotatable fashion on a rotatably mounted throttle-valve shaft 2. Furthermore, a double-armed driver lever 4 is arranged in non-rotatable manner on a throttle-valve shaft 2, said shaft being urged by a return spring 5 in clockwise direction and thus in the closing direction of the throttle valve 3.

Below the driver lever 4, a throttle-valve setting lever 6 is arranged, mounted rotatably on the throttle-valve shaft 2, the lever 6 resting via a driver 7 from below against a righthand lever arm of the driver lever 4. On the lower end of the throttle-valve setting lever 6, there acts a rod 8 which can be displaced by the accelerator pedal 9 between an idling position LL and a full-load position VL. If the accelerator pedal 9 moves from the idling position LL shown in the direction of the full-load position VL, then the throttle-valve setting lever 6 swings in counterclockwise direction. In this connection, the driver 7 swings the driver lever 4 in the same direction of rotation, so that the throttle valve 3 opens increasingly.

A motor-setting lever 10 extends from above into the throttle valve housing 1. This motor setting lever 10 is also mounted rotatably on the throttle-valve shaft 2 and has a driver 11 which rests from above against the left lever arm of the driver lever 4. For automatic motorized displacement operation of the throttle valve 3 for control the idling, there is provided a pneumatic-setting motor 12 which has a setting member 13 which can be moved to the left, as seen in the drawing, by the action of vacuum on the setting motor 12 against the force of a setting spring 14. There is of importance for the invention a path-dependent controlling movement-reversal device 15 which connects the end of the setting member 13 with the motor setting lever 10, and by which the result is obtained that, upon movement of the setting member 13 to the left, the motor setting lever 10 is first of all swung in clockwise direction and then in counterclockwise direction (the sequence indicated by the position of FIG. 3 followed by the position of FIG. 2 followed by the position of FIG. 4).

In the case of the embodiment shown in FIG. 2, the movement-reversal device 15 has an intermediate lever 16 which is pivoted on the end of the setting member and is connected by a toggle-lever articulation 17 to the motor setting lever 10. In the stretched position, shown in FIG. 2, the intermediate lever 16 lies against an upward pointing driver 18 of the motor setting lever 10. A leg spring 19, arranged on the toggle-joint articulation 17, acts on the intermediate lever 16 and the motor-setting lever 10 in such a manner that these two levers attempt to move out of their stretched position with respect to each other.

For the operation of the movement-reversal device, it is furthermore important that the intermediate lever 16 rest against a stop 20 fastened to the housing on the side facing away from the driver 18 between the toggle-lever articulation 17 and the setting member 13.

Figure 3:
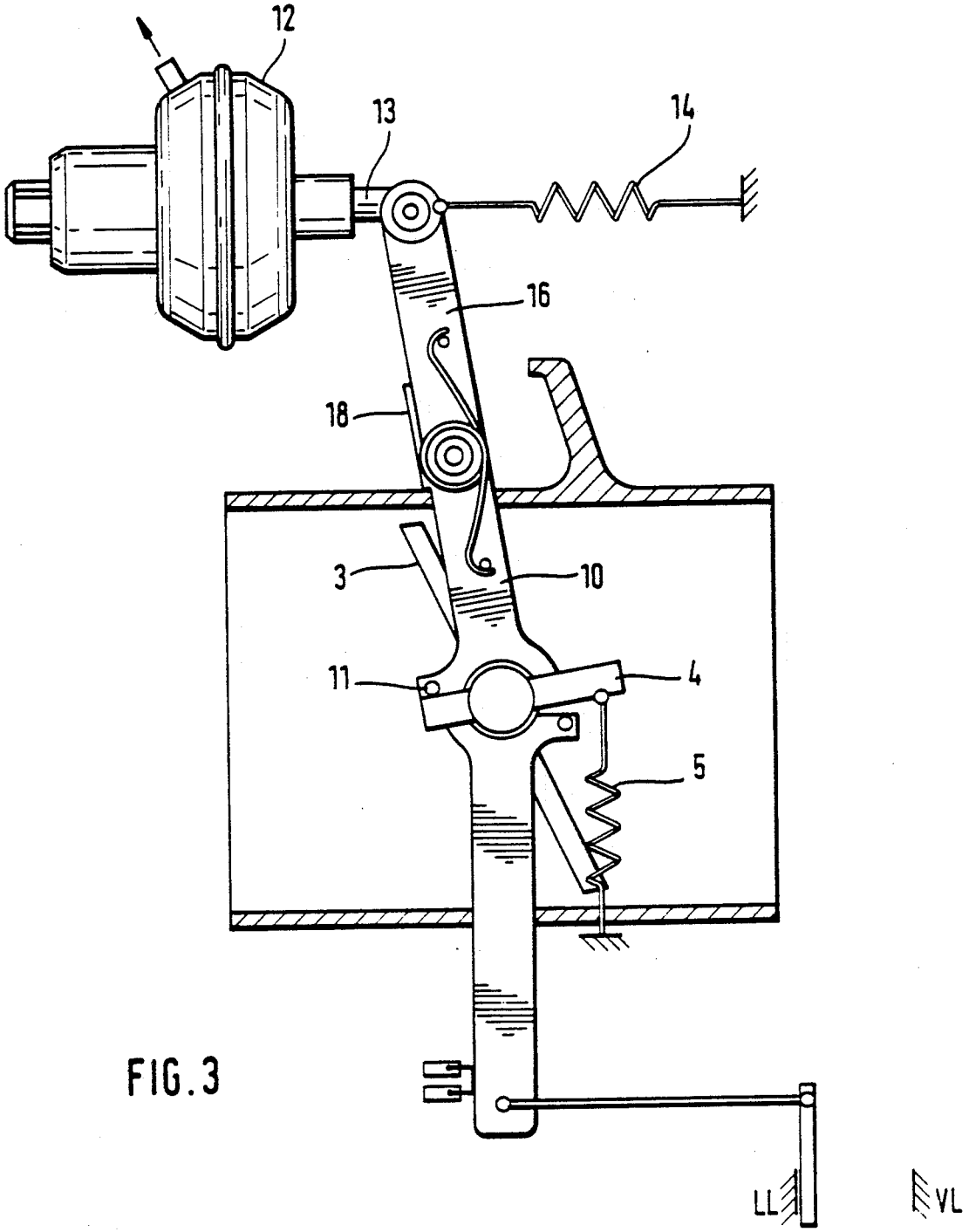
FIG. 3 is a basic diagram of the throttle-valve setting device of the invention in the position which results with maximum idling opening of the throttle valve.

FIG. 3 shows that position of the structural parts described above which results when the setting motor is acted on by energy in the end position and, therefore, in that position in which the throttle valve 3 is open maximum upon the idling control. The setting member 13 is, in this case, moved maximally into the setting motor 12 so that the intermediate lever 16 has been correspondingly swung to the maximum amount to the left against the force of the setting spring 14. Since the intermediate lever 16 rests against the driver 18, the motor setting lever 10 concurrently has been swung in counterclockwise direction. The setting lever 10, by means of its driver 11, presses against the driver lever 4 and thereby has also swung the latter in counterclockwise direction against the force of the return spring 5 so that the throttle valve 3 has been correspondingly opened.

Figure 4:
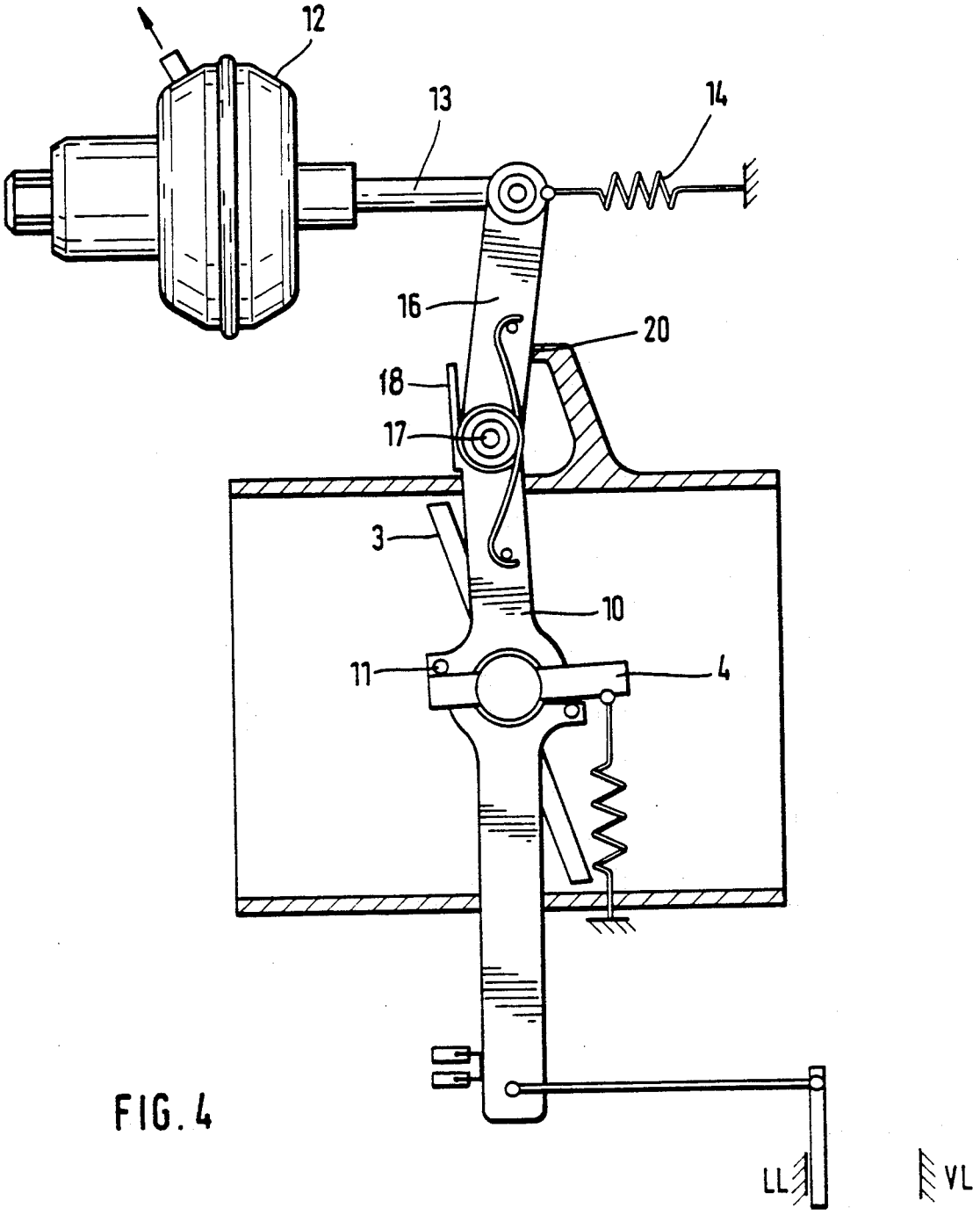
FIG. 4 is a basic diagram of the throttle valve setting device of the invention in the position which results when the setting motor is not activated.

During the idling control, the structural parts shown move between the end positions shown in FIGS. 2 and 3. FIG. 4 shows an emergency position which results upon failure of activation of the setting motor 12. In this position, the setting spring 14 has pulled the setting member 14 so far to the right, as seen in FIG. 4, that the intermediate lever 16 has been swung in clockwise direction slightly around the stop 20, which has led to an inward movement of the toggle-lever joint 17 and thus to a swinging of the motor setting lever 10 in counterclockwise direction. In this way, the motor setting lever 10 has been able, via the driver 11, to swing the driver lever 4 slightly in counterclockwise direction so that the throttle valve 3 is in a somewhat more open position than in FIG. 2.

Figure 5:
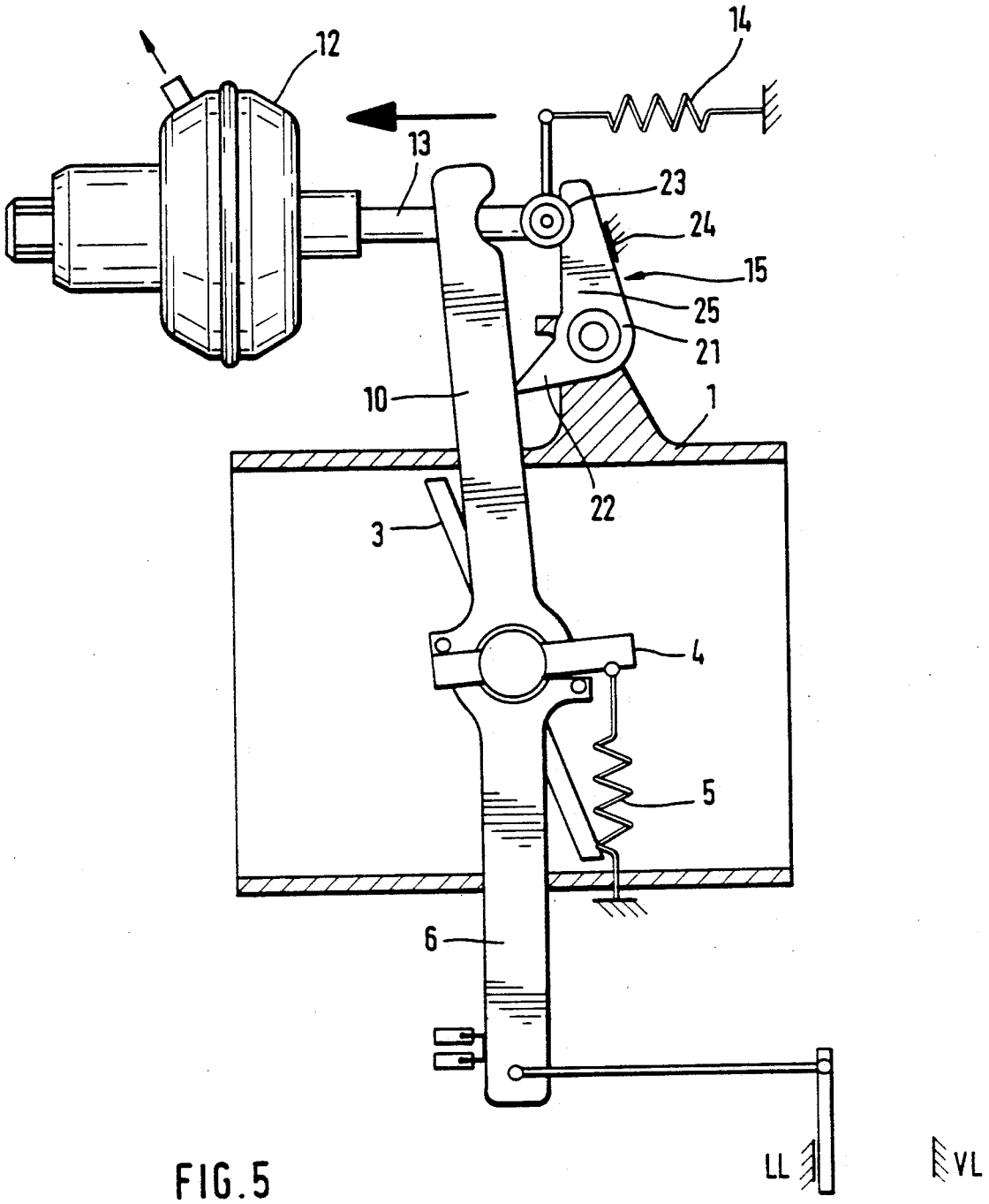
FIG. 5 is a basic diagram of a second embodiment of a throttle valve setting device in the position which results when the setting motor is not activated.

In the embodiment according to FIG. 5, the movement-reversal device 15 has a bell-crank lever 21 which is swingably mounted on the throttle-valve housing 1 and rests, with the end of a lever arm 22, against the motor-setting lever 10 which, in this embodiment, is extended out of the throttle-valve housing 1. The setting member 13 of the setting motor 12 has a driver 23 on its end and, when the setting motor 12 is not acted on by pressure, is held by the setting spring 14 against the lever arm 25 of the bell-crank lever 21 so that the latter rests against a stop 24 which is fastened to the housing.

If the setting motor is acted on by vacuum, then the setting member 13 starts to move toward the left. In this way the bell-crank lever 21 swings in counterclockwise direction because the motor setting lever 10 presses against the lever arm 22 under the action of the return swing 5. The motor setting lever 10 thus follows the backward moving lever arm 22 toward the right. In this way the throttle valve 3 moves in closing direction. When the setting member 13 has been shifted so far to the left that the driver 23 comes against the motor setting lever 10, the driver 23 then moves the motor setting lever 10 with it toward the left. In this way, the driver lever 4 is swung in counterclockwise direction, which leads to an opening of the throttle valve 3.

Figure 6:
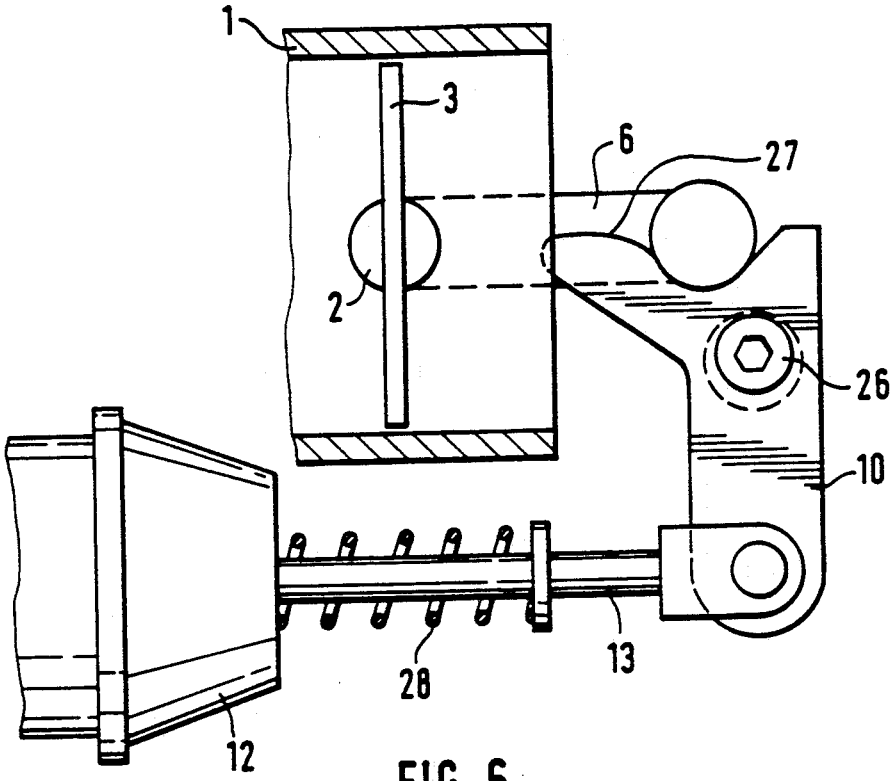
FIG. 6 is a basic diagram of a third embodiment of the throttle valve setting device of the invention in the position which results upon minimum idling opening of the throttle valve.

In the embodiment of the invention shown in FIG. 6, the motor setting lever 10 is developed as a double-armed lever which is swingable around a shaft 26, developed as adjustment eccentric. The setting motor 12 is articulated on the lower motor-lever arm of the motor setting lever 10, as shown in FIG. 6, by the setting member 13. The other lever arm has, on its free end, a lift cam 27 which is so shaped that the motor setting lever 10 as a whole has the shape of a boot, the travel surface of which is formed by the lift cam 27. Against this lift cam there rests the throttle-valve setting lever 6 which is firmly connected to the throttle-valve shaft 2 which actuates the throttle valve 3 in the throttle-valve housing 1. A setting spring 28 which is arranged on the setting member 13 urges the motor setting lever 10 in counterclockwise direction of rotation. In the position of the parts shown in FIG. 6, the throttle valve 3 is closed. The setting motor 12 must, in this case, be activated on by electric current, or hydraulic pressure or vacuum, depending on the construction of the motor 12.

Figure 7:
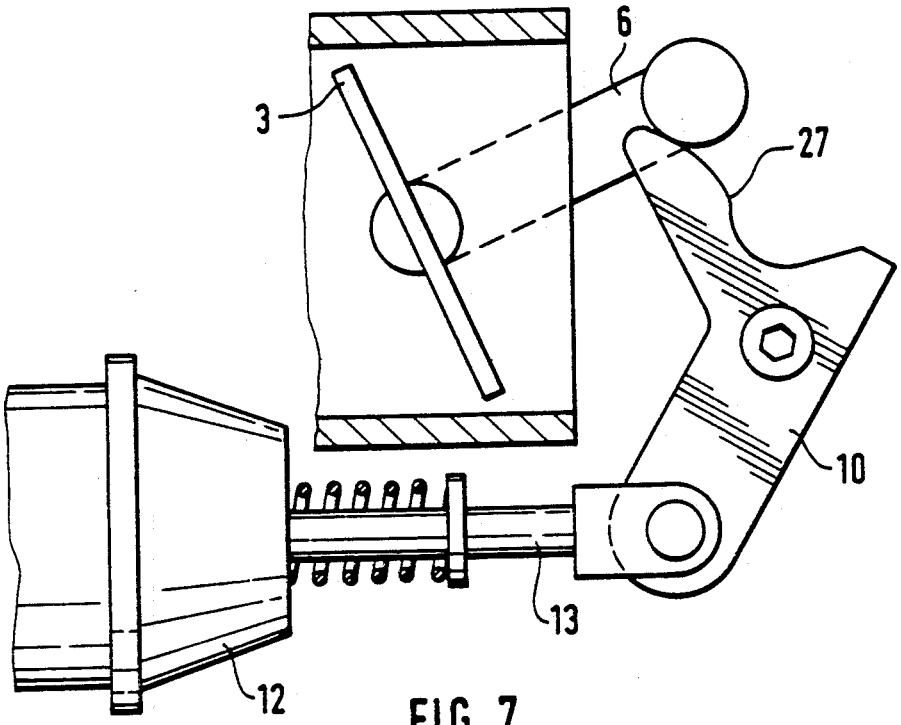
FIG. 7 is a basic diagram of the throttle valve setting device of FIG. 6 in the position which results upon maximum idling opening of the throttle valve.

If the setting motor 12 is acted on by more current than in FIG. 6, the setting member 13 is increasingly pulled into the setting motor 12. The position which results upon maximum flow of current, in which the throttle valve 3 is maximally open, is shown in FIG. 7. The motor setting lever 10 has, in this connection, swung so far in clockwise direction that its lift cam 27 has swung the throttle-valve setting lever 6 correspondingly in counterclockwise direction and now rests with a lefthand region of the lift cam 27 against the throttle-valve setting lever 6.

Figure 8:
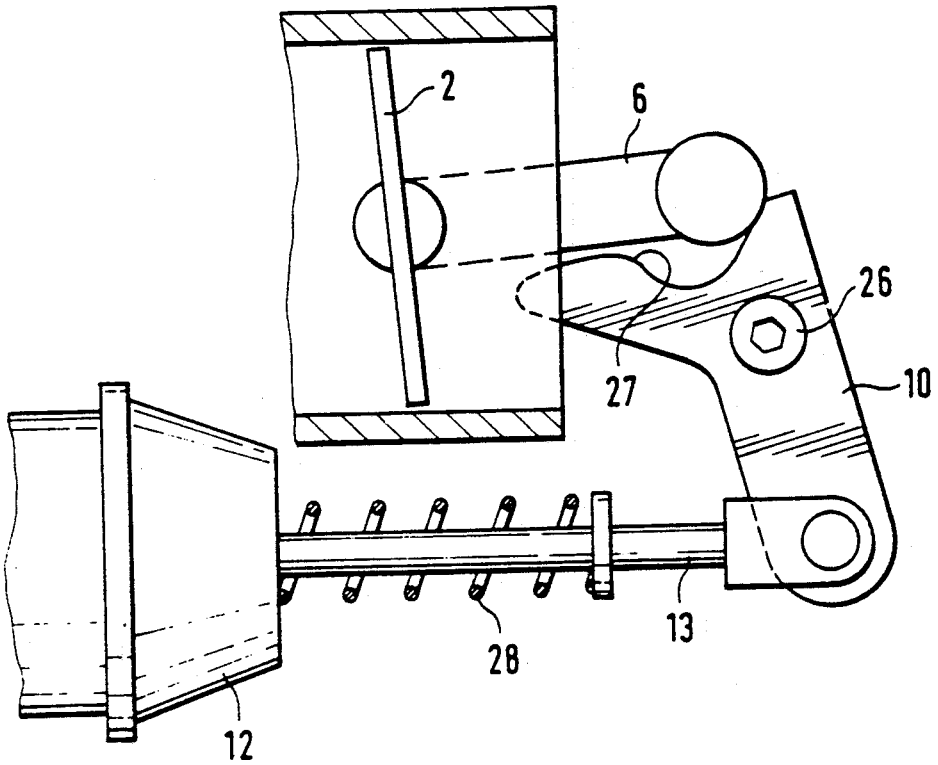
FIG. 8 is a basic diagram of the throttle valve setting device of FIGS. 6 and 7 in the position which results when the setting motor is not activated.

If the electric energy of the setting motor 12 fails, then the setting member 13 moves a maximum amount out of the setting motor 12 as a result of the action of the setting spring 28, and the motor-setting lever 10 is swung in counterclockwise direction around its shaft 10. The position of the parts which results from this is shown in FIG. 8. The lift cam 27 then presses with a region forming the shape a shoulder, or heel of the boot, against the throttle-valve setting lever 6. The throttle valve 2 is opened slightly in this emergency position. Thus the same dependence results between the throttle valve angle and the setting path of the setting member 13 in the embodiment of FIGS. 2–5 as in the embodiment according to FIGS. 6–8.

We claim:

1. A throttle-valve setting device operative in response to the position of an accelerator pedal, the setting device comprising;

a throttle valve setting lever which is connected to an accelerator pedal;

a throttle valve arranged, fixed for rotation, on a throttle valve shaft, and actuated by said setting lever;

a return spring;

a setting motor operating exclusively in the opening direction of the throttle valve against a force of said return spring in order to permit idling adjustment;

a setting member displaceable by said setting motor; in a first direction and displaceable by said return spring in a second direction opposite said first direction a movement-reversal device which mechanically interconnects said setting member and said setting lever to provide for actuation of the throttle valve by said setting motor, said movement-reversal device switching as a function of a distance of movement of said setting member; and wherein upon a displacement of the setting member by said return spring, the throttle valve first swings in the closing direction and then, upon further displacement of the setting member, in the opposite direction.

2. A valve setting device according to claim 1, further comprising a double-armed driver lever is connected, fixed for rotation, on said throttle-valve shaft;

a second return spring for urging said driver lever in a closing direction of the throttle valve;

a first and a second driver element respectively on a first and a second arm of said driver lever; and wherein said movement-reversal device includes a motor setting lever pivoted about said throttle-valve shaft;

said valve setting lever pushes said driver lever in a first rotational direction by said first driver element, and said motor setting lever pushes said driver by said second driver element in a second rotational direction opposite said first rotational direction.

3. A valve setting device according to claim 2, wherein said movement-reversal device includes an intermediate lever which is pivoted about said motor setting lever by a toggle-joint lever pivot, and by a further pivot is pivotally connected to said motor, there being a stop fixed in position relative to a housing of the throttle valve for contacting said intermediate lever a location between said toggle-joint lever pivot and said further pivot;

said intermediate lever is held in an end position of travel of said motor setting member, during a state of deactivation of said setting motor, by said first-mentioned setting spring against said stop; and said motor setting lever has, on a side of said intermediate lever opposite said stop, a third driver for contacting said intermediate lever during a pivoting of the intermediate lever in a setting direction of the setting motor.

4. A valve setting device according to claim 3, wherein said toggle-joint lever pivot includes a leg spring; and the motor setting lever and the intermediate lever are urged into the inward position by said leg spring, said leg spring being weaker than said setting spring.

5. A valve setting device according to claim 1, wherein said movement-reversal device comprises a motor setting lever, and a bell-crank lever, said motor setting lever contacting one lever arm of said bell-crank lever to form a tilt axis, and said motor setting member being urged against a second lever arm of said bell-crank lever by said setting spring; and at the end of said motor setting member there is a driver which after a short stroke, in a direction which results upon activation of said setting motor arrives against the motor setting lever.

6. A valve setting device according to claim 1, wherein said movement-reversal device comprises a motor setting lever, and on the motor setting lever, said throttle-valve setting lever contacting said cam.

7. A valve setting device according to claim 6, wherein said movement-reversal device includes a shaft, and said motor setting lever is formed as a double-arm lever of which one arm is swingable around said shaft and pivotally connects with said motor setting member; and a second arm of said double-armed lever including said cam.

8. A valve setting device according to claim 7, wherein the shaft of said movement-reversal device is developed as an adjustment eccentric which permits displacement of the motor setting lever.

* * * * *